US005408989A

United States Patent [19]

Vestal, Sr.

[11] Patent Number: 5,408,989

[45] Date of Patent: Apr. 25, 1995

[54] FIREPLACE GRATE

[75] Inventor: David M. Vestal, Sr., Sweetwater, Tenn.

[73] Assignee: Vestal Manufacturing Company, Sweetwater, Tenn.

[21] Appl. No.: 276,009

[22] Filed: Jul. 15, 1994

[51] Int. Cl.[6] ..... F24B 1/193

[52] U.S. Cl. ..... 126/540; 126/152 R

[58] Field of Search ..... 126/540, 152 R, 153, 126/541, 500; 211/194; 108/53.3, 53.1, 53.5; 206/599

[56] References Cited

U.S. PATENT DOCUMENTS

| | | | |
|---|---|---|---|
| D. 253,027 | 10/1979 | Whitaker | D8/207 |
| 2,903,218 | 9/1959 | Altenburg | 248/126 |
| 3,620,157 | 12/1971 | Ortenblad | 108/53 |
| 3,622,031 | 11/1971 | Wells | 220/19 |
| 3,867,887 | 2/1975 | Saidel | 108/53.3 |
| 4,262,651 | 4/1981 | Fajt | 126/202 |
| 4,413,737 | 11/1983 | Wind | 206/599 |
| 4,428,306 | 1/1984 | Dresen et al. | 108/53.3 |
| 4,892,088 | 1/1990 | Vestal, Sr. | 126/540 |

FOREIGN PATENT DOCUMENTS

| | | | |
|---|---|---|---|
| 674374 | 6/1952 | United Kingdom | 126/540 |

*Primary Examiner*—James C. Yeung

*Attorney, Agent, or Firm*—James W. Grace

[57] ABSTRACT

A fireplace grate having legs and cut-out portions adjacent the legs, the cut-out portions of one fireplace grate receive the legs of a second fireplace grate when the two fireplace grates are nested together.

13 Claims, 5 Drawing Sheets

FIREPLACE GRATE

BACKGROUND OF THE INVENTION

1. Field of the Invention

This invention relates generally to fireplace accessories and relates more particularly to fireplace grates for supporting fireplace fuels in a spaced relationship with the floor of a fireplace.

2. Description of the Prior Art

Conventional fireplace grates include a rigid framework including a ribbed upper surface and legs for support the upper surface in a generally horizontal disposition with respect to the underlying fireplace floor. Due to their size, conventional grates are known to present problems relating to the warehousing or storage of large quantities of the grates. Fireplace grates can be manufactured with removable legs to thereby reduce the grate height for storage purposes and thereby relieve, to some extent, the storage-related problems attending the grates. The removable legs, however, are separate components which require special consideration when packing the grates for shipment and which require attachment to the remainder of the grate prior to use.

Other fireplace grates have hollow legs which permit the legs of one fireplace grate to nest in the hollow portion of the legs of another fireplace grate. However, it has been found that an unacceptably high scrap rate occurs in the manufacture of such hollow-legged fireplace grates.

It would be desirable to provide a new and improved fireplace grate manufacturable as a single unit and which facilitates storage of a large quantity of similar grates in a relatively small amount of space.

OBJECTS OF THE INVENTION

It is an object of the present invention to provide such a grate possessing a construction which accommodates a casting of the grate as a single unit with a relatively low scrap rate.

It is another object of the present invention to provide such a grate which is durable in construction and effective in operation.

It is a further object of the present invention to provide a fireplace grate which is easily nestable with other similar fireplace grates.

SUMMARY OF THE INVENTION

This invention resides in a fireplace grate for supporting fireplace fuels above the floor of a fireplace.

The grate includes means defining a support surface upon which fireplace fuels are placed for burning and a plurality of legs for supporting the support surface above the fireplace floor. Each leg includes a body which is attached to the support surface-defining means. The support surface has openings which are so located that upon rotation of 180° in a horizontal plane, a second fireplace grate can be nested with respect to a first fireplace grate, the leg of a grate of like construction placed in overlying relationship therewith so that a plurality of grates of like construction can be stacked in a superposed relationship with the legs of each grate nestingly accepted by the openings of an overlying grate. The first two fireplace grates are inverted in their nested position. Additional fireplace grates can be stacked on top of the lowest two in a similar manner.

DESCRIPTION OF THE PREFERRED EMBODIMENT

Figure 1:
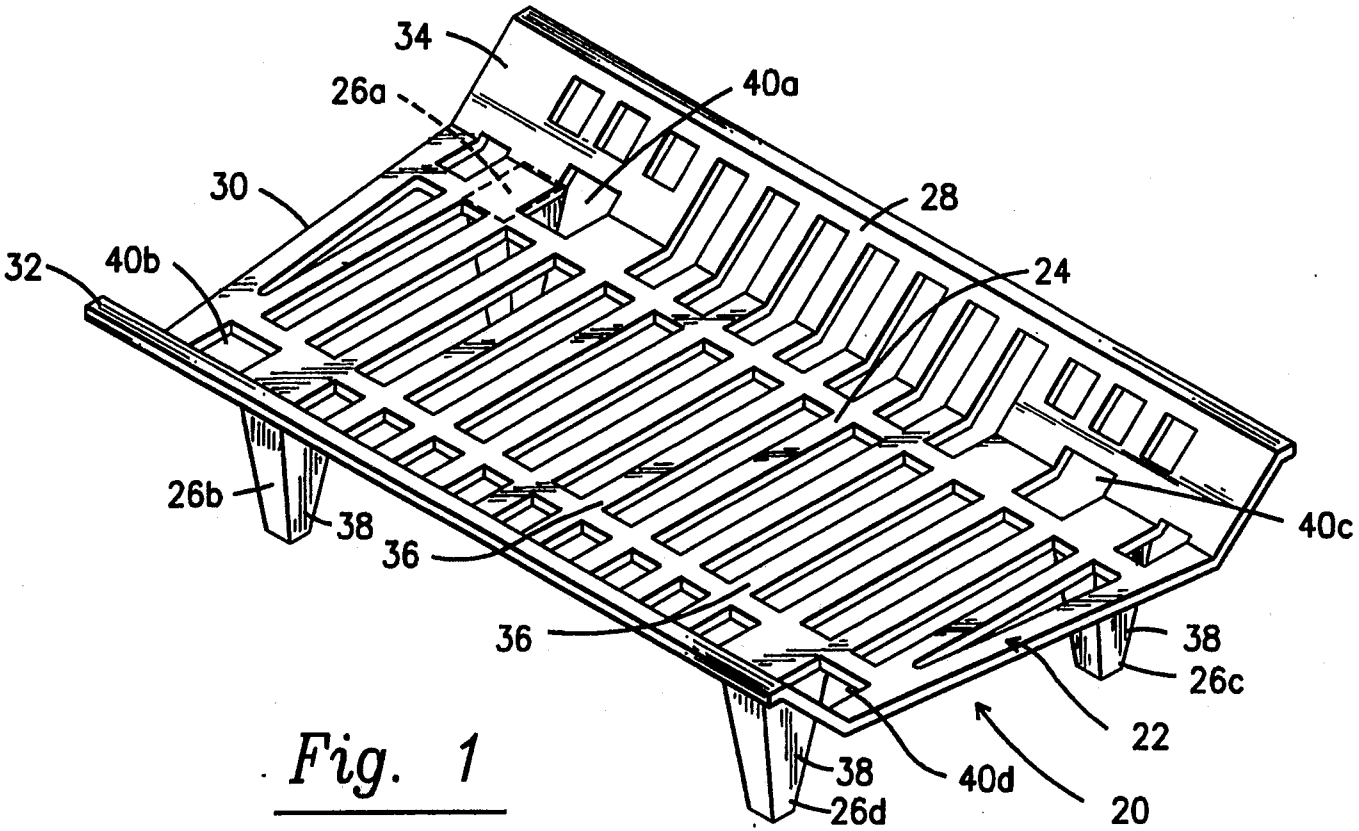
FIG. 1 is a perspective view of an embodiment of a fireplace grate.

Turning now to the drawings in greater detail, there is illustrated in FIG. 1 an embodiment, generally indicated 20, of a fireplace grate for supporting fireplace fuels, such as logs or kindling, above the floor of a fireplace. The grate 20 is preferably constructed of cast iron and includes means, indicated 22, defining a support surface 24 having a top surface and a bottom surface upon which the fireplace fuels are placed for burning and four legs **26*a*, 26*b*, 26*c*, and 26*d* integrally joined to the bottom surface of support surface-defining means 22**.

The support surface-defining means 22 is in the form of an elongated frame 28 having a horizontally-disposed mid-portion 30 providing a planar upper surface and opposite forward and rearward portions 32, 34, respectively, which are joined to so as to extend angularly upwardly from the mid-portion 30. The upper surfaces of each of the mid-portion, forward and rearward portions 30, 32, 34 collectively provide the top support surface 24. In addition and with reference again to FIGS. 1 and 2, the frame 28 includes a plurality of ribs 36 suitably joined together so as to provide a number of elongated openings extending across the frame 28 in a front-to-back orientation. As fireplace fuels are burned upon the support surface 24, ashes are permitted to fall through the openings provided between the ribs 36 to the fireplace floor below.

With reference to FIG. 1, each leg 26 includes a body 38 which is integrally joined to the bottom surface of portion 30 so as to depend downwardly from the support surface-defining means 22 and maintain the support surface 24 in a spaced relationship with the underlying fireplace floor (not shown). Body 38 of each leg is a solid casting integrally molded to the underside of a solid portion of the surface-defining means 22.

Figure 2:
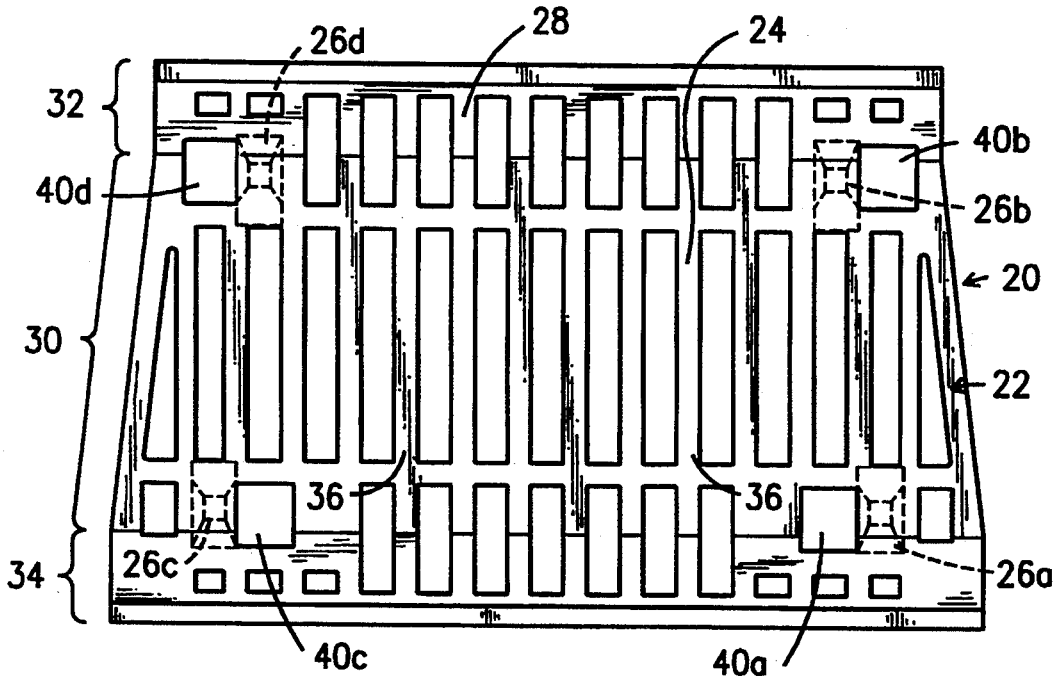
FIG. 2 is a top plan view of the fireplace grate of FIG. 1.

As more clearly shown in FIG. 2, next to each leg **26*a*, 26*b*, 26*c*, and 26*d* is a cut-out portion 40*a*, 40*b*, 40*c*, and 40*d*** which is designed to receive a corresponding leg of a similar fireplace grate when the grates are nested.

Figure 3:
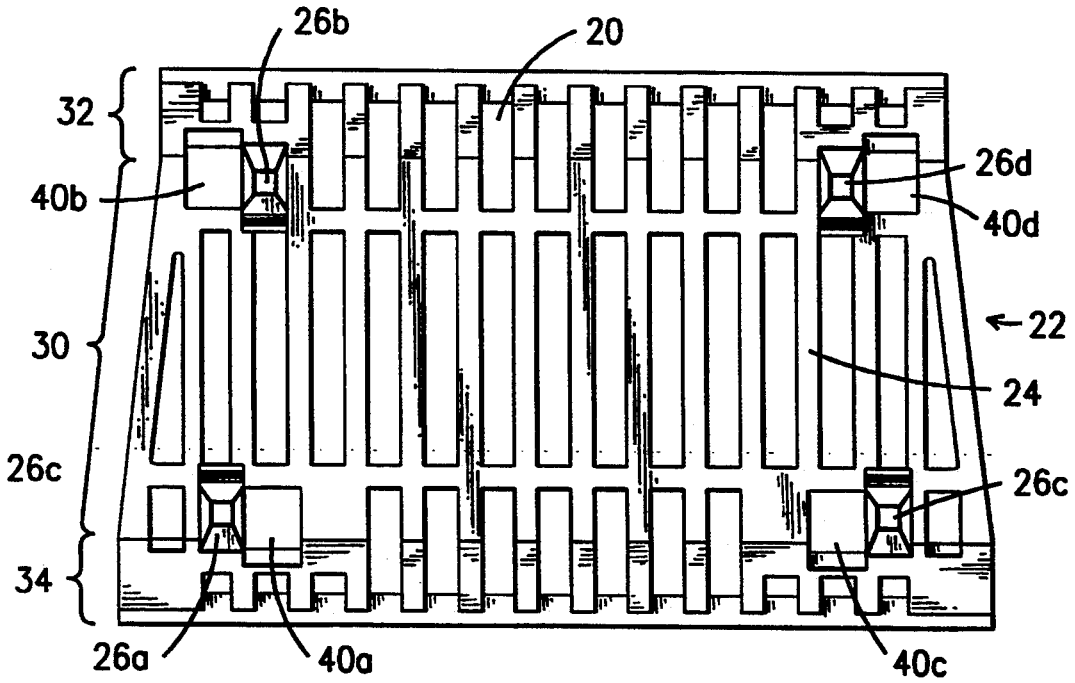
FIG. 3 is a bottom plan view of the fireplace grate of the invention.

Legs **26*a*, 26*b*, 26*c*, 26*d* are shown in dotted lines in FIG. 2 (top view) and in solid lines in FIG. 3 (bottom view). Legs 26*a* and 26*c*, which are located in the area at the junction of mid-portion 30 and rearward portion 34 of grate 20 are located outwardly of cut-out portions 40*a* and 40*c*. Legs 26*b* and 26*d*, which are located in the area at the junction of mid-portion 30 and forward portion 32 are located inwardly of cut-out portions 40*b* and 40*d***.

Figure 4:
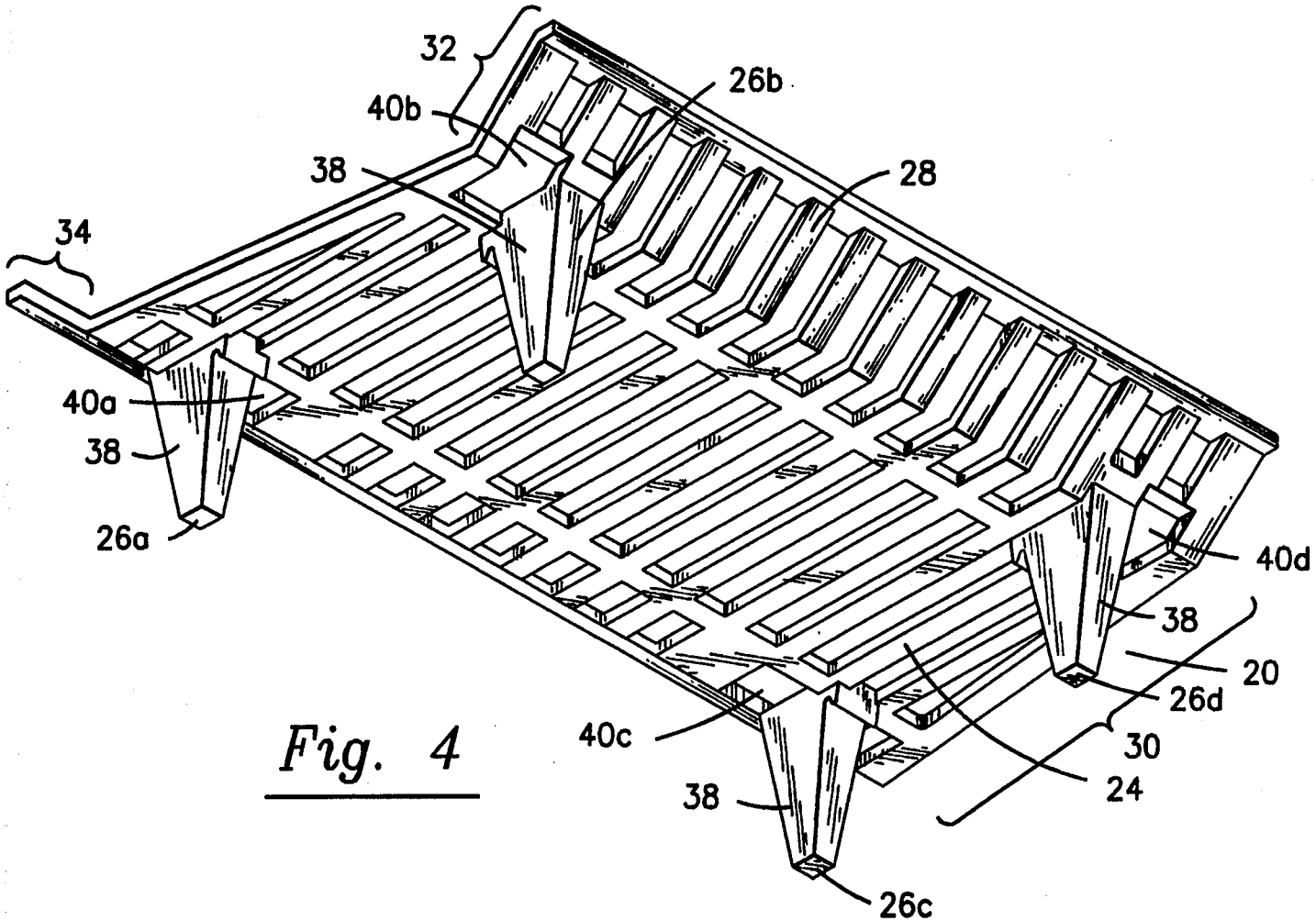
FIG. 4 is a perspective bottom view of the fireplace grate of the invention.

Referring now to FIG. 4, which is a perspective view of the underside of the fireplace grate of the invention, there is therein shown a fireplace grate 20 having a rear raised portion 34, a central flat portion 30, and a raised front portion 32. Legs 26*a*, 26*b*, 26*c*, and 26*d* are integrally molded to the underside of central flat portion 30 and are located near the four opposite corners of the fireplace grate so that a firm support is provided for the grate. A pair of cut-out portions 40*a* and 40*c* are located inwardly of legs 26*a* and 26*c*, respectively. A pair of cut-out portions 40*b* and 40*d* are located outwardly of legs 26*b* and 26*d*, respectively.

Figure 5:
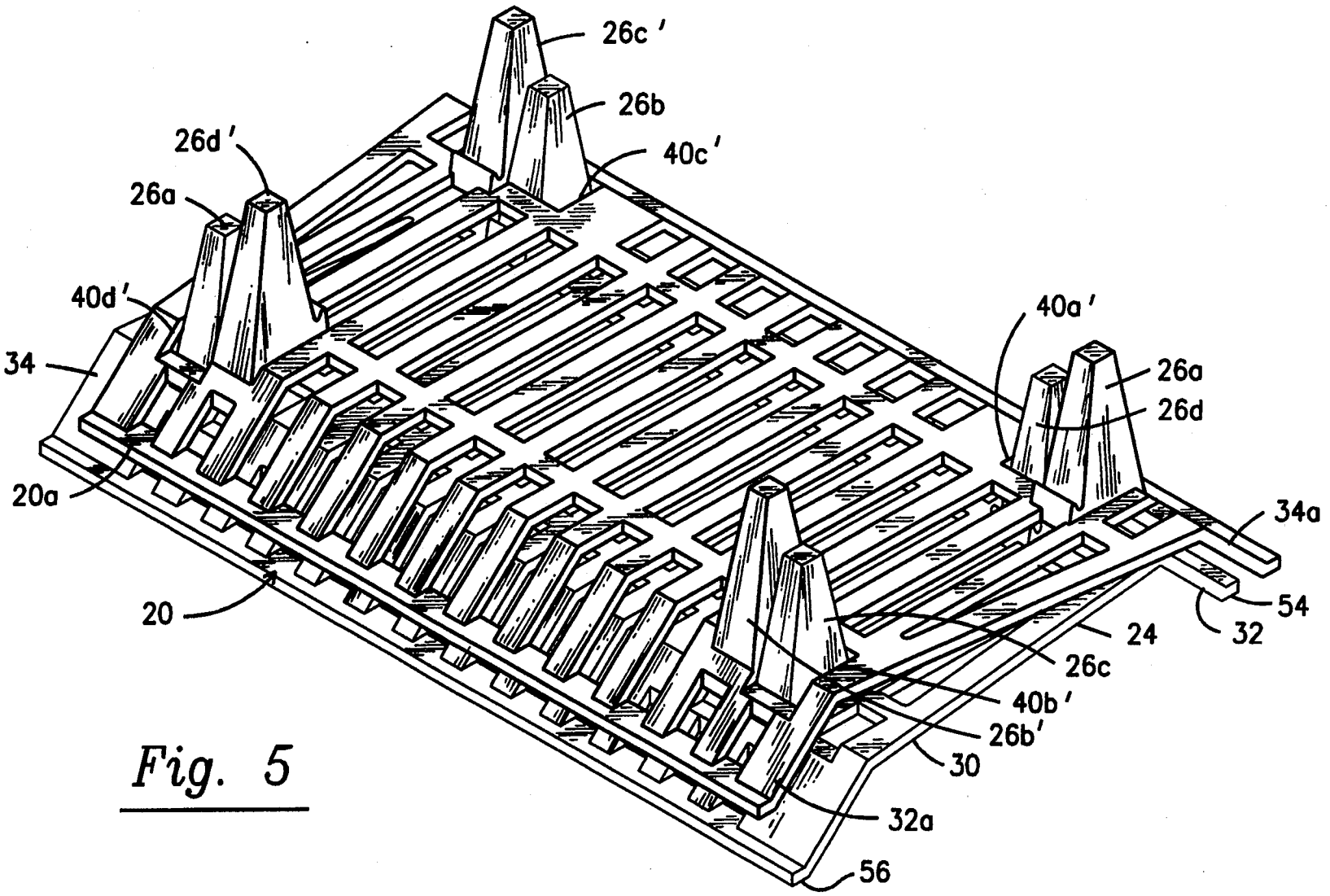
FIG. 5 is a perspective view of the fireplace grate of FIG. 1 and a grate of like construction when stacked upon the fireplace grate of FIG. 1.

In packing for shipment, the nestable fireplace grates of the invention are positioned so as to lie one above another in a stacked array with the lowermost fireplace grate being placed face downward on a pallet. Reference may be had to FIG. 5 which is a perspective view of two pairs of nested fireplace grates.

The lowermost fireplace grate 20 is placed face downwardly on a pallet 52 (not shown). The flat face 54 of forward portion 32 and the flat face 56 of rearward portion 34 of fireplace grate 20 lie upon the upper surface of pallet 52. The main portion 30 of fireplace grate 22 spans between forward portion 32 and rearward portion 34 with legs 26*a*, 26*b*, 26*c*, and 26*d* extending in an upward direction.

A second fireplace grate 20*a* is placed on top in nesting fashion with respect to first fireplace grate 20. Before placing fireplace grate 20*a* on top of fireplace grate 20, fireplace grate 20*a* is rotated 180° in a horizontal plane so that leg 26*a* of fireplace grate 20 extends upwardly through cut-out portion 40*d*′ of fireplace grate 20*a* and leg 26*c* of fireplace grate 20 extends through cut-out portion 40*b*′ of fireplace grate 20*a*.

In like manner, leg 26*b* of fireplace grate 20 extends upwardly through cut-out portion 40*c*′ of fireplace grate 20*a* and leg 26*d* of fireplace grate 20 extends through cut-out portion 40*a*′ of fireplace grate 20*a*.

A shelf 58 is shown near the base of each leg 26*a*, 26*b*, 26*c*, and 26*d* to form a support for the next fireplace grate lying above an under-supporting fireplace grate.

A second pair of fireplace grates 20*b* and 20*c* are placed above fireplace grates 20 and 20*a*. In this case the face 60 of fireplace grate 20*b* lies on top of the end of legs 26*c*′ and 26*a*′ of fireplace grate 20*a*.

In like manner, other fireplace grates can be stacked above other grates in pairs.

The face of angled forward portion 32*a* of fireplace 20*a* rests on the underside of rearward portion 34 of fireplace grate 20. In like manner, the face of rearward portion 34*a* of fireplace grate 20*a* rests on the underside of forward portion 32 of fireplace grate 20.

In this way the two nested fireplace grates can be packed with a minimum of vertical space being occupied. The problem of making hollow legs which will fit into one another is avoided by making all the legs solid. In this way, there is a savings of material and less loss in production.

Additional fireplace grates can be placed above the first pair to form a vertical stack of fireplace grates. The additional fireplace grates are assembled in pairs similar to fireplace grates 20 and 20*a*.

Figure 6:
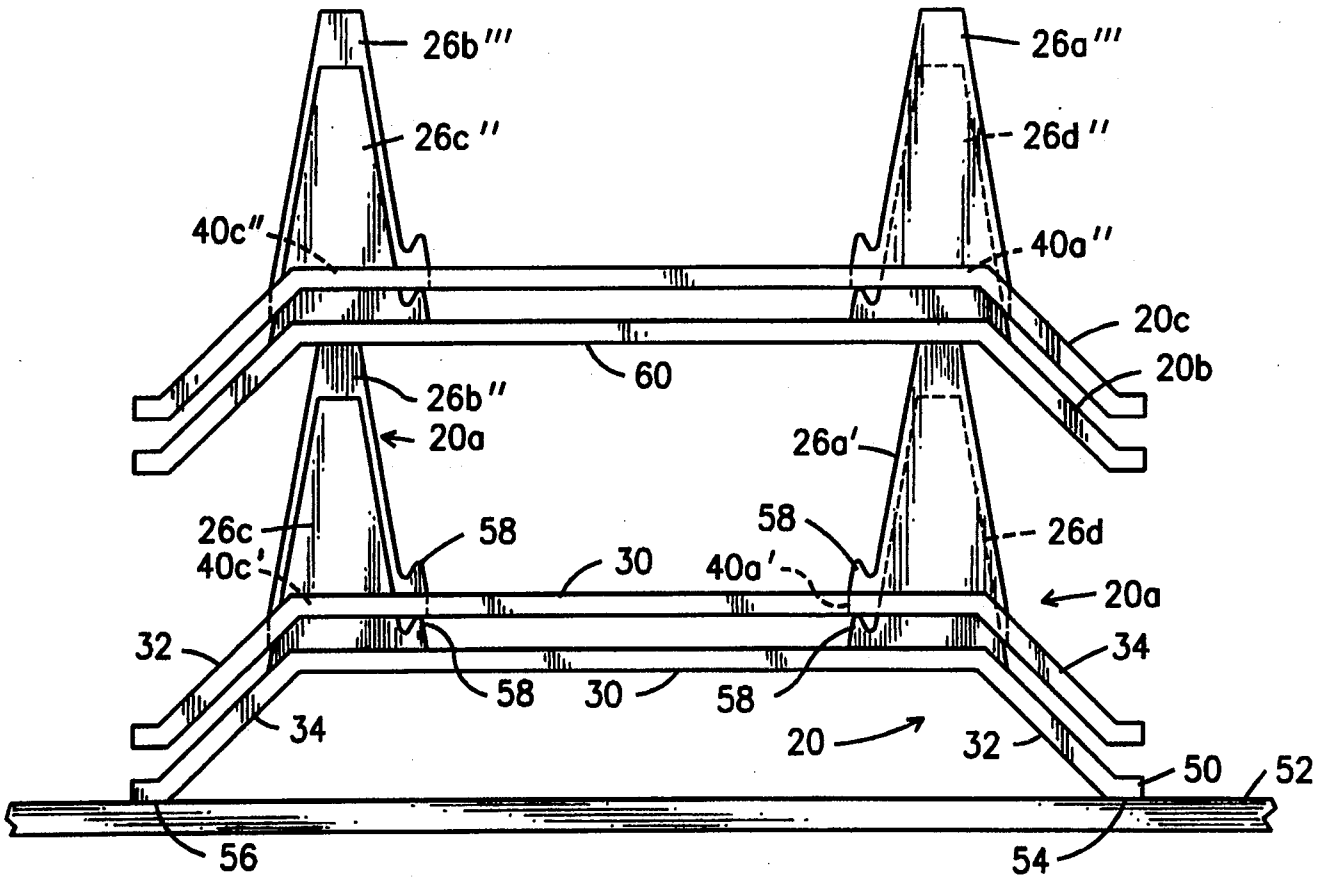
FIG. 6 is an end view of 2 pairs of fireplace grates of the invention in nested condition.

Referring to FIG. 6, there is shown two pairs of fireplace grates assembled for shipment. In this case a lower pair of fireplace grates 20 and 20*a* are shown nested on top of a pallet 52 in the manner shown in FIG. 5. A second pair of fireplace grates 20*b* and 20*c* are placed on top of the lower pair of fireplace grates. The underside 60 of fireplace 20*b* rests on the ends of the now vertically upwardly extending legs 26*a*′, 26*b*′, 26*c*′, and 26*d*′ of fireplace grate 20*a*. The legs 26*a*, 26*b*, 26*c* and 26*d* of fireplace grate 20 do not extend as high as legs 26*a*′, 26*b*′, 26*c*′, and 26*d*′ of fireplace grate 20*a* and so they do not form a support for fireplace grates 20*b* and 20*c*.

As shown more clearly in FIG. 6, there are short shelves 58 on each of the legs. These shelves serve as platforms to support the underside of a fireplace grate placed on top of a lower fireplace grate. In this way, the nested fireplace grates have a short space between their surfaces.

While the nested fireplace grates as shown in FIG. 5 are illustrated with the top surface of fireplace grates 20 and 20*a* are facing downwardly, this illustration is only to show the preferred method of preparation of fireplace grates for storage and shipment. It is also possible to nest fireplace grates 20 and 20*a* so that their top surfaces face upwardly and the nested fireplace grates 20 and 20*a* rest on the downwardly depending legs of the lowermost fireplace grate.

While the legs 26*a*, 26*b*, 26*c*, and 26*d* are shown as being rectangular in cross-section, each of the legs may also be round or oval in cross section. In which case, the configuration of the corresponding cut-out portions will be the same cross-section.

While the present invention has been illustrated and described in connection with an improved fireplace grate, it is to be understood that other variations will occur to those skilled in the art and it is intended to cover this embodiment and other variations in the accompanying claims.

I claim:

1. A fireplace grate comprising:

means defining a support surface upon which fireplace fuels are placed for burning, said means having an upper surface and a bottom surface, a plurality of legs for supporting said surface defining means above the floor of a fireplace, each of said legs being attached to said bottom surface of said surface defining means and extending downwardly therefrom, a plurality of cut-out portions in said support surface defining means, said plurality of cut-out portions being equal to said plurality of legs, each of said cut-out portions being located next to a corresponding one of said legs, said cut-out portions being located so that each of said cut-out portions will receive a leg of a second similar fireplace grate when said second fireplace grate is nested on said support surface defining means.

2. A fireplace grate as recited in claim 1 in which said legs and said cut-out portions are of the same cross-sectional configuration.

3. A fireplace grate as recited in claim 1 in which each of said legs and said cut-out portions are of square cross-sectional configuration.

4. A fireplace grate as recited in claim 1 in which said support surface defining means has a flat central portion, an upwardly-extending, forward-angled portion and an upwardly-extending rearward-angled portion.

5. A fireplace grate as recited in claim 4 in which each of said legs is integrally attached to said bottom surface of said flat central portion of said support surface defining means.

6. A fireplace grate comprising:

means defining a support surface upon which fireplace fuels are placed for burning;

a plurality of legs for supporting said surface defining means above the floor of a fireplace, each of said legs being attached to said surface defining means, said surface defining means having a flat portion, an upwardly angled forward portion and a rearward upwardly angled portion, said legs being arranged in spaced pairs, said legs of the first one of said pairs of legs being spaced apart from each other and being located in spaced relationship at the intersection of said flat portion and said forward upwardly angled portion, said legs of the second one of said pair of legs being spaced apart from each other and being located in spaced relationship at the intersection of said flat portion and said rearwardly upwardly angled portion, a plurality of cut-out portions located in said flat portion, each of said cut-out portions being located adjacent an associated one of said legs, said plurality of cut-out portions being equal to said plurality of legs, said cut-out portions being arranged so that a cut-out portion is located inwardly of each of said legs of said first one of said pairs of legs and a cut-out portion is located outwardly of each of said legs of said second one of said pairs of legs.

7. A nested pair of fireplace grates comprising: a first fireplace grate comprising means defining a support surface upon which fireplace fuels are placed for burning, said means having an upper surface and a bottom surface, a plurality of legs for supporting said surface defining means above the floor of a fireplace, each of said legs being attached to said bottom surface of said surface defining means and extending downwardly therefrom, a plurality of cut-out portions in said support surface defining means, said plurality of cut-out portions being equal to said plurality of legs, each of said cut-out portions being located next to a corresponding one of said legs, said cut-out portions being located so that each of said cut-out portions will receive a leg of a second similar fireplace grate where said second fireplace grate is nested on said support surface defining means, a second fireplace grate identical in configuration as that of said first fireplace grate, said second fireplace grate being nested with said first fireplace grate so that the legs of said second fireplace grate extend through said cut-outs in said first fireplace grate and the upper surface of said second fireplace grate rests upon the bottom surface of said first fireplace grate.

8. A nested pair of fireplace grates as recited in claim 7 in which said second fireplace grate is rotated 180° in a horizontal place prior to being nested on said first fireplace grate.

9. A fireplace grate comprising:

means defining a support surface upon which fireplace fuels are placed for burning, said means having an upper surface and a bottom surface, four legs for supporting said surface defining means above the floor of a fireplace, each of said legs being attached to said bottom surface of said surface defining means and extending downwardly therefrom, four cut-out portions in said support surface defining means, each of said cut-out portions being located next to a corresponding one of said legs, said cut-out portions being located so that each of said cut-out portions will receive a leg of a second similar fireplace grate when said second fireplace grate is nested on said support surface defining means.

10. A fireplace grate as recited in claim 9 in which said legs and said cut-out portions are of the same cross-sectional configuration.

11. A fireplace grate as recited in claim 9 in which each of said legs and said cut-out portions are of square cross-sectional configuration.

12. A fireplace grate as recited in claim 9 in which said support surface defining means has a flat central portion, an upwardly-extending, forward-angled portion and an upwardly-extending rearward-angled portion.

13. A fireplace grate as recited in claim 12 in which each of said legs is integrally attached to said bottom surface of said flat central portion of said support surface defining means.

* * * * *